United States Patent [19]

Hisano et al.

[11] 4,303,369

[45] Dec. 1, 1981

[54] METHOD OF AND SYSTEM FOR CONTROLLING STRESS PRODUCED IN STEAM TURBINE ROTOR

[75] Inventors: Katsukuni Hisano; Hitoshi Isa; Hazime Sibaoka, all of Hitachi, Japan

[73] Assignee: Hitachi, Ltd., Tokyo, Japan

[21] Appl. No.: 36,985

[22] Filed: May 8, 1979

[30] Foreign Application Priority Data

May 10, 1978 [JP] Japan ..... 53-56082

[51] Int. Cl.[3] ..... F01K 13/02; F01D 21/14; F01D 17/00; F01D 19/00

[52] U.S. Cl. ..... 415/1; 415/17; 415/47

[58] Field of Search ..... 415/47, 17, 1; 60/660, 60/646, 657

[56] References Cited

U.S. PATENT DOCUMENTS 3,588,265 6/1971 Berry ..... 415/1

3,891,344 6/1975 Braytenbah ..... 415/1

3,928,972 12/1975 Osborne ..... 60/660

4,091,450 5/1978 Bloch et al. ..... 415/17

4,173,869 11/1979 Martin, Jr. et al. ..... 415/47

*Primary Examiner*—Philip R. Coe

*Assistant Examiner*—Timothy F. Simone

*Attorney, Agent, or Firm*—Craig and Antonelli

[57] ABSTRACT

A stress controlling system for a rotor of a steam turbine determines thermal and rotational conditions of the rotor. Thermal and centrifugal stresses produced in the rotor during operation of the steam turbine are calculated from the thermal and rotational conditions, respectively, of the rotor. Also, brittle fracture toughness of the material of the rotor under the thermal condition determined is calculated. Operation of the steam turbine is controlled to prevent the calculated brittle fracture toughness from being exceeded by the combined stress of thermal and centrifugal stresses during operation of the steam turbine.

11 Claims, 9 Drawing Figures

METHOD OF AND SYSTEM FOR CONTROLLING STRESS PRODUCED IN STEAM TURBINE ROTOR

BACKGROUND OF THE INVENTION (1) Field of the Invention

This invention relates to steam turbines, and more particularly to a method of and a system for controlling thermal and centrifugal stresses produced in the rotor of a steam turbine during operation of the steam turbine.

In recent years, the need to meet efficiently the ever-increasing demand for electric power has markedly increased the capacity of each steam turbine plant. This has made it necessary to operate a power plant in a manner to cope successfully with variations in the demand for electric power, particularly to deal with the difference in the demand for electric power between daytime and nighttime. Thus, a power plant hitherto operated at base load or with a constant turbine power is nowadays required to frequently effect startup, shutdown and load changes. Operation transients such as startup, shutdown and load changes produce thermal stress of high magnitude in the steam turbine rotor. Thus, in controlling stresses produced in the steam turbine rotor, it is important to control thermal stress produced by the aforesaid operation transients. It is also necessary to take into consideration centrifugal stress which would be produced in the turbine rotor during its rotation. The problem of stress control may be considered to be the problem of preventing excess life consumption of the turbine rotor by controlling operation of the steam turbine or the problem of controlling the life of the turbine rotor. With regard to the analysis of thermal and centrifugal stresses produced in a turbine rotor and the problem of controlling turbine rotor life, a prior paper is cited which is entitled 'The Operation of Large steam Turbines to Limit Cyclic Thermal Cracking' by D. T. Timo and G. W. Sarney (ASME Paper No. 67-WA/PWR-4, published in 1967).

(2) Description of the Prior Art

In one method known in the art for controlling stress produced in a steam turbine rotor, the stress produced at the surface of the rotor and the stress produced at the rotor bore are controlled. According to this method, life consumption of the turbine rotor is controlled by taking into consideration low-cycle fatigue caused by thermal stress of the base portions of a high-pressure initial stage disk and a reheating initial stage disk of the steam turbine rotor in respect of the surface of the rotor, and by taking into consideration thermal stress and creep life in respect of the rotor bore. A problem raised with regard to this method has been that brittle fracture of the turbine rotor is not taken into consideration when stress control is effected. Generally, high-pressure and medium-pressure sections of a turbine rotor are formed of material of high high-temperature brittle fracture toughness because they are usually exposed to heat of high temperature. As a result, these sections have low low-temperature brittle fracture toughness. These sections of the turbine rotor are exposed to steam of relatively low temperature when the number of revolutions increases at startup. Thus, in controlling stress produced in the turbine rotor, the low low-temperature brittle fracture toughness of the material of these sections should be taken into consideration. Also, stress control should be effected by taking into consideration high-temperature fracture toughness of the material of a low-pressure section of the rotor during operation of the steam turbine at load, because such material is low in high-temperature brittle fracture toughness.

SUMMARY OF THE INVENTION

Accordingly, an object of the present invention is to provide a method of and a system for controlling stress produced in the rotor of a steam turbine, the stress control being effected in such a manner that the brittle fracture toughness of the rotor is not exceeded by stress produced in the rotor during operation of the steam turbine.

Another object is to provide a method of and a system for controlling stress produced in the rotor of a steam turbine, the stress control being effected in such a manner that the low-temperature brittle fracture toughness of the material of high-pressure and medium-pressure sections of the rotor of the steam turbine is not exceeded by stress produced in these sections.

A further object is to provide a method of and a system for controlling stress produced in the rotor of a steam turbine, the stress control being effected in such a manner that the high-temperature brittle fracture toughness of the material of a low-pressure section of the rotor is not exceeded by stress produced in this section.

According to one of the features of the invention, the total value of thermal and centrifugal stresses produced in the rotor of a steam turbine during operation of the steam turbine is controlled such that it becomes smaller than the brittle fracture toughness of the material of the rotor.

Preferably, the total value of thermal and centrifugal stresses produced in a medium-pressure section of the rotor during operation of the steam turbine is prevented from exceeding the low-temperature brittle fracture toughness of the material of the medium-pressure section of the rotor, while the total value of thermal and centrifugal stresses produced in a low-pressure section of the rotor is prevented from exceeding the high-temperature brittle fracture toughness of the material of the low-pressure section of the rotor.

The above and other objects as well as features and advantages of the invention will become more apparent from the following desription of embodiments when read in conjunction with the accompanying drawings.

BRIEF DESCRIPTION OF THE DRAWINGS

Like reference characters designate same or similar parts throughout the drawings.

DESCRIPTION OF THE PREFERRED EMBODIMENT

Figure 1:
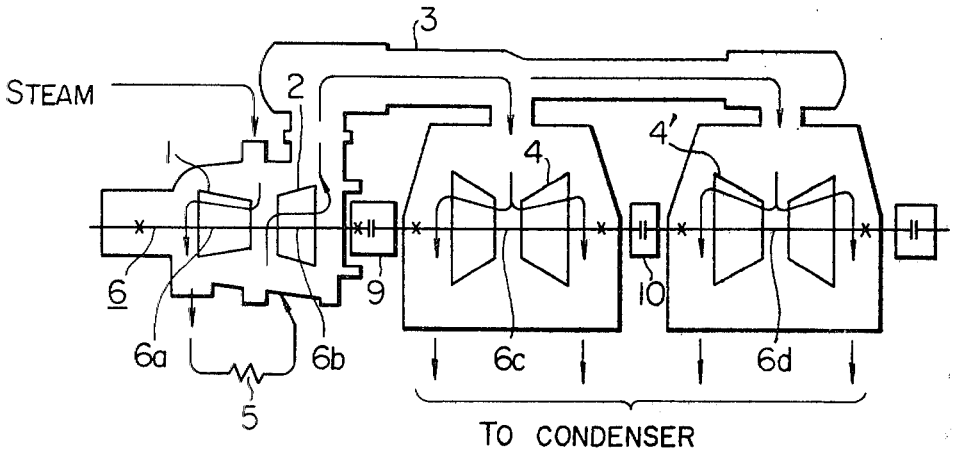
FIG. 1 is a schematic view of a four-flow type steam turbine used in an electric power plant or the like, showing its general construction.
Figure 3:
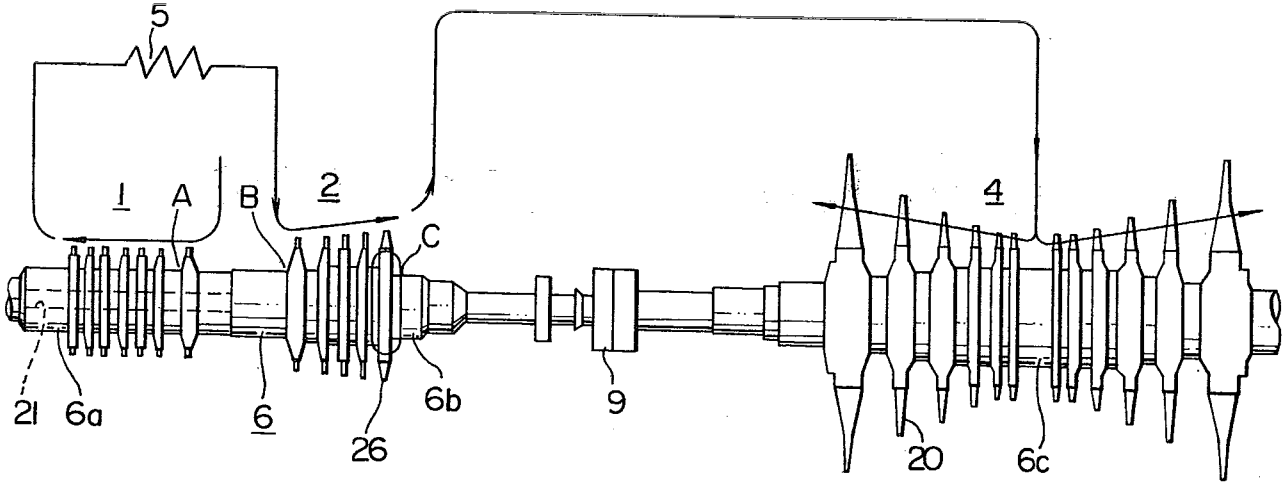
FIG. 3 is a schematic view of a rotor mounted in the steam turbine shown in FIG. 1.
Figure 9:
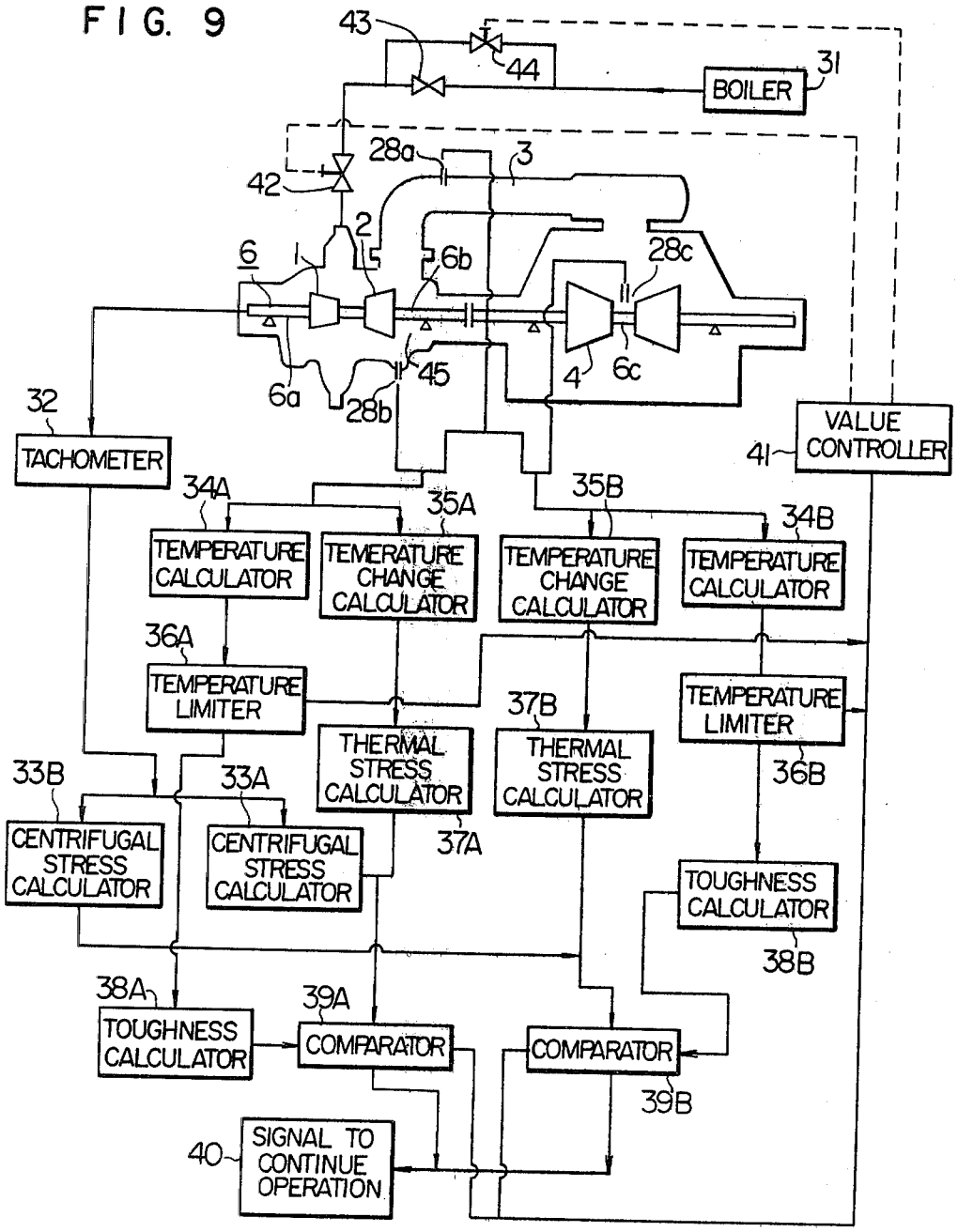
FIG. 9 is a diagrammatic representation of the system for controlling stress produced in the turbine rotor according to an embodiment of the present invention.

FIG. 1 illustrates a typical steam turbine of the four-flow type to which the present invention may be applied. The steam turbine is of known construction and includes a high-and-medium pressure turbine having a high-pressure turbine 1 and a medium-pressure turbine 2, and low-pressure turbines 4 and 4'. As indicated by arrows in FIGS. 1 and 3, steam produced in a boiler, not shown, first flows through high-pressure turbine 1, and then flows through medium-pressure turbine 2 after being reheated in a reheating boiler 5. The steam released from medium-pressure turbine 2 is fed to low-pressure turbines 4 and 4' via a crossover conduit 3, and then led to a condenser, not shown. A turbine rotor 6 includes a high-pressure rotor section **6*a* located in high-pressure turbine 1, a medium-pressure rotor section 6*b* located in medium-pressure turbine 2, and low-pressure rotor sections 6*c* and 6*d* located in low-pressure turbines 4 and 4' respectively. Rotor 6 is rotated by the steam passing through turbines of different pressures. In FIGS. 1 and 3, 9 designates a joint between medium-pressure rotor section 6*b* and low-pressure rotor section 6*c*, and 10 designates a joint between low-pressure rotor sections 6*c* and 6*d*. In this steam turbine, high-pressure rotor section 6*a* and medium-pressure rotor section 6*b* are integral with each other to constitute a high-and-medium-pressure rotor section, and low-pressure rotor section 6*d*** is connected to for example a generator, not shown, of the electric power plant.

Figure 2:
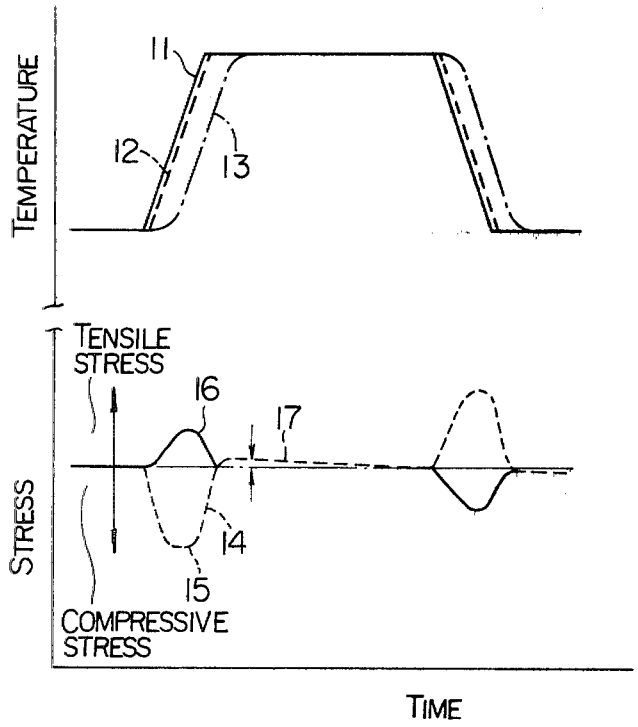
FIG. 2 is a view in explanation of production of stresses in the turbine rotor when the steam shows variations in temperature.

In the steam turbine shown in FIG. 1, changes in the temperature of steam acting on the turbine rotor 6 would cause high thermal stress to be produced in the rotor 6 at startup, shutdown and load changes. Production of thermal stress in the turbine rotor 6 at cold startup in which steam of high temperature flows into the turbine rotor 6 maintained substantially at room temperature will be described by referring to FIG. 2. A solid line 11 in FIG. 2 represents the temperature of steam that has passed through the first stage or the high-pressure turbine of the steam turbine. At steam turbine startup, the temperature of the surface of the turbine rotor 6 rises as indicated by a broken line 12 as steam passes through the first stage of the steam turbine, and the rise in temperature would produce compressive stress at the surface of the turbine rotor 6 as indicated by a broken line 14. The compressive stress is maximized in value at portions of the turbine rotor where stress is concentrated, such as the base portions of the disks of the turbine rotor, with the maximum value exceeding a minus yielding point 15. Production of the compressive stress results in a production of residual tensile stress 17 in steady-state operation in which the rotor is maintained at a constant temperature. Meanwhile the temperature of the rotor bore shows a change as indicated by a dash-and-dot line 13 during this process, and this change in temperature produces tensile stress as indicated by a solid line 16. At steam turbine shutdown involving a drop in the temperature of the turbine rotor, the stress 14 at the surface of the turbine rotor changes into tensile stress and the stress 16 at the rotor bore changes into compressive stress. Production of thermal stress described hereinabove is described in detail in the ASME Paper No. 67-WA/PWR-4 referred to at the beginning of this specification.

Figure 4:
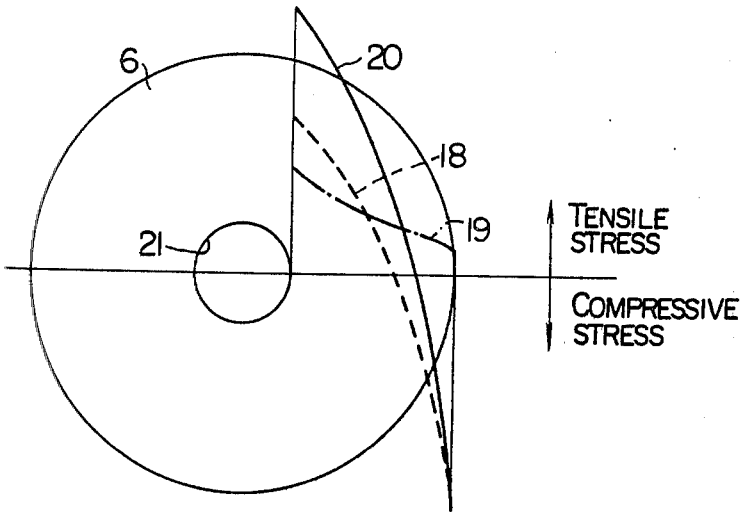
FIG. 4 is a schematic view showing the distribution of stresses in the cross section of the rotor at cold startup.

As is clear from the foregoing description, thermal stress of high magnitude is produced at the surface of the turbine rotor, particularly at the base portions of the rotor disks, and at the rotor bore, at steam turbine startup and shutdown. In addition to the aforesaid thermal stress, centrifugal stress is produced in the turbine rotor due to its rotation. FIG. 4 shows the distribution of stresses acting on the cross section of the turbine rotor at cold startup of the steam turbine. In FIG. 4, a broken line 18 and a dash-and-dot line 19 represent thermal stress and centrifugal stress respectively produced in turbine rotor 6 at cold startup, and a solid line 20 represents a total or combined stress of the thermal and centrifugal stresses. As can be clearly seen in FIG. 4, thermal stress (compressive stress) of very high magnitude and centrifugal stress (tensile stress) of low magnitude are produced at the surface of the turbine rotor, while thermal stress (tensile stress) and centrifugal stress (tensile stress) of relatively high magnitude act on the rotor bore 21. Although FIG. 4 shows the distribution of stress at cold startup alone, it will be apparent from FIG. 2 that tensile thermal stress of very high magnitude is produced at the surface of the turbine rotor and compressive thermal stress of relatively high magnitude is produced at the rotor bore at steam turbine shutdown. Also, at steam turbine shutdown, centrifugal stress similar to that shown in FIG. 4 is produced in accordance with the number of revolutions of the turbine rotor at steam turbine shutdown.

By taking into consideration the stresses produced in the turbine rotor as described hereinabove, it has hitherto been customary to effect control of stresses produced at the surface of the turbine rotor and at the rotor bore as follows: with regard to the surface of the rotor where thermal stress of very high magnitude and centrifugal stress of low magnitude are produced at steam turbine startup and shutdown, control of life consumption is effected by paying special attention to low-cycle fatigue caused by thermal stress of the base portion A of the high-pressure initial stage disk and the base portion B of the reheating initial stage disk, shown in FIG. 3, where the thermal stress has a particularly high value and stress is concentrated, and with regard to the rotor bore 21, control of life consumption is effected by paying attention to both centrifugal stress affecting the creep life of turbine rotor and thermal stress.

In our view, the aforesaid method of stress control of the prior art is not sufficient since brittle fracture of the turbine rotor is not taken into consideration. Generally, the high-and-medium-pressure section of the turbine rotor is formed of material of high high-temperature brittle fracture toughness because this section is exposed to heat of high temperature, so that this section has low low-temperature brittle fracture toughness. Thus, when steam of relatively low temperature flows into the high-and-medium-pressure rotor section and centrifugal and thermal stresses act on this rotor section at steam turbine startup, there would be the possibility that brittle fracture would occur in the rotor. The material of the low-pressure rotor section has high low-temperature brittle fracture toughness but is low in high-temperature brittle fracture toughness. Therefore, when the low-pressure rotor section is exposed to high temperature and subjected to thermal and centrifugal stresses, there would be the possibility that brittle fracture would occur in the low-pressure rotor section.

Figure 5:
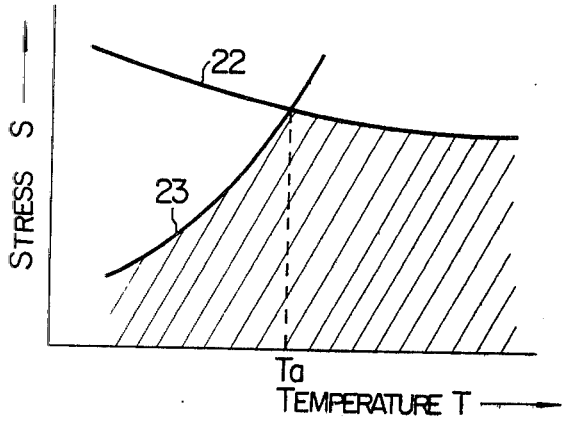
FIG. 5 is a schematic view in explanation of changes caused by temperature in the ductile fracture condition and brittle fracture condition of materials such as the material of the turbine rotor.

FIG. 5 shows changes in a ductile fracture condition 22 and a brittle fracture condition 23 of the material of the turbine rotor which would be caused by variations in temperature. As can be seen clearly in FIG. 5, the value of stress S in the brittle fracture condition 22 or brittle fracture toughness of this kind of material generally drops as the temperature T becomes lower. More specifically, in FIG. 5, a reduction in temperature T below a predetermined value Ta brings about a reduction in the value of stress in the brittle fracture condition 23 or brittle fracture toughness below the value of stress in the ductile fracture condition 22 or ductile fracture toughness. Therefore, when the temperature of the material of the turbine rotor drops below the predetermined value Ta, brittle fracture toughness should be taken into consideration in effecting control of stress produced in the turbine rotor.

Figure 6:
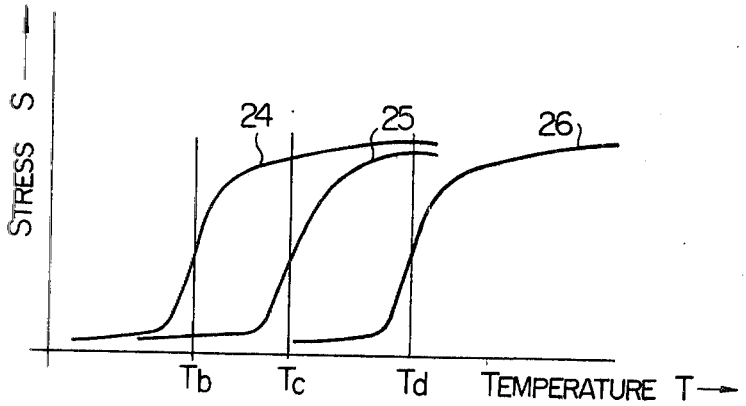
FIG. 6 is a schematic view showing brittle fracture toughness and changes in brittle fracture condition of materials such as material of the turbine rotor, the changes being caused by embrittlement of the material by high temperature.

FIG. 6 shows the brittle fracture toughness of the material referred to hereinabove in relation to a fracture appearance transition temperature (FATT), wherein curves 24 and 26 represent brittle fracture conditions of the materials when the latter are not embrittled. The brittle fracture condition of the materials having high low-temperature brittle fracture toughness, such as the material for the low-pressure rotor sections, is represented by the curve 24, while the brittle fracture condition of the materials having high high-temperature brittle fracture toughness, such as the material for the high-and-medium pressure rotor section is represented by the curve 26. As will be understood from the curves 24 and 26, the brittle fracture toughnesses of the materials are suddenly reduced as the temperature drops below the FATTs(Tb) and (Td) of the respective materials. It is therefore necessary to control operation of the steam turbine such that the turbine rotor materials are maintained always at temperatures above the FATTs. In the case of the materials such as the material for the low-pressure rotor section which has high low-temperature brittle fracture toughness, there is the possibility that the high-temperature embrittlement of the materials would occur when the materials are exposed to the steam of high temperature. The brittle fracture condition of the materials thus embrittled due to high temperature is represented by a curve 25. A comparison of curves 24 and 25 shows that the FATT (Tc) of the material embrittled by high temperature is higher than the FATT (Tb) of the material not embrittled. From this, it will be apparent that even if the turbine rotor is used at temperatures above the FATT (Tb), brittle fracture could be caused to the rotor as the rotor material is subjected to high-temperature embrittlement. As can be seen from a curve 27 in FIG. 7, the rise in FATT of the material of the low-pressure rotor section, i.e., the difference in value between the FATT (Tc) and the FATT (Tb), is suddenly increased above the temperature (Te). Thus, it is necessary that the material of the low-pressure rotor section is maintained below the temperature (Te) at which high-temperature embrittlement is caused.

In view of the observations described hereinabove, we have found that it is effective to carry out stress control as described hereinafter. First, in respect of the high-and-medium-pressure rotor section formed of material of low low-temperature brittle fracture toughness, the temperature to which this rotor section is exposed is controlled by taking into consideration the brittle fracture condition 22 shown in FIG. 5. Preferably, this temperature control is effected by determining the temperature of a low temperature portion of the medium-pressure rotor section. That is, in the turbine rotor shown in FIG. 3, for example, temperature control is preferably effected by determining the temperature of nearby areas of a final stage disk C of the medium-pressure rotor section *6b*. This is because of the fact that the low-temperature portion of the medium-pressure rotor section *6b* is a portion in which temperature becomes relatively low and on which centrifugal stress of high magnitude acts due to the large length and mean diameter of a moving blade 26, with the result that brittle fracture is most liable to occur in this portion of all the portions of high-pressure and medium-pressure rotor sections *6a* and *6b*.

Temperature control of high-pressure and medium-pressure rotor sections *6a* and *6b* may be effected as follows. First, steam turbine operation is controlled in such a manner that the temperature of the low-temperature portion of the medium-pressure rotor section *6b* does not drop below the FATT (Td) shown in FIG. 6. Stating differently, temperature control is effected with a view to preventing a marked reduction in brittle fracture toughness which would be caused by the drop of the temperature of the medium-pressure rotor section *6b* below the FATT (Td). Secondly, in the low-temperature portion of the medium-pressure rotor section *6b* in which centrifugal stress of particularly high magnitude is produced, even if its temperature is above the FATT (Td), temperature control is effected in such a manner that the brittle fracture toughness of the material is not exceeded by the value of the combined stress of centrifugal stress and thermal stress.

Figure 7:
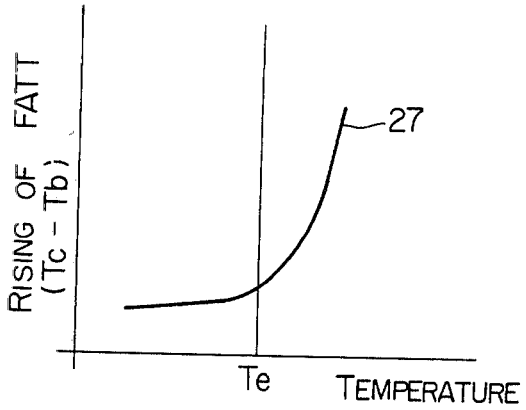
FIG. 7 schematically illustrates the relation between the high-temperature embrittlement of the turbine rotor material and the fracture appearance transition temperature change.

In effecting stress control of low-pressure rotor sections 4 and 4' shown in FIGS. 1 and 3, it is necessary to take into consideration the embrittlement by high temperature of the material of these rotor sections. The low-pressure rotor sections are formed of material of low high-temperature brittle fracture toughness. Because of this, inflow of steam of high temperature into the low-pressure rotor sections would cause embrittlement by high temperature of the material of these rotor sections, as shown in FIG. 7. As described by referring to FIGS. 6 and 7, the FATT rises from Tb to Tc when embrittlement is caused by high temperature. Thus in respect of the low-pressure rotor sections, it is necessary to carry out temperature control as follows: Firstly, the control should be effected to maintain the temperature blow the temperature Te (FIG. 7), thereby preventing embrittlement by high temperature of the material of these rotor sections. Secondly, the control should be effected to prevent the value of combined stress of thermal stress and centrifugal stress produced in the low-pressure rotor sections from exceeding the brittle fracture toughness of the material which takes into consideration embrittlement by high temperature, even in the case where the temperature control is effected to prevent high-temperature embrittlement of the material.

Figure 8:
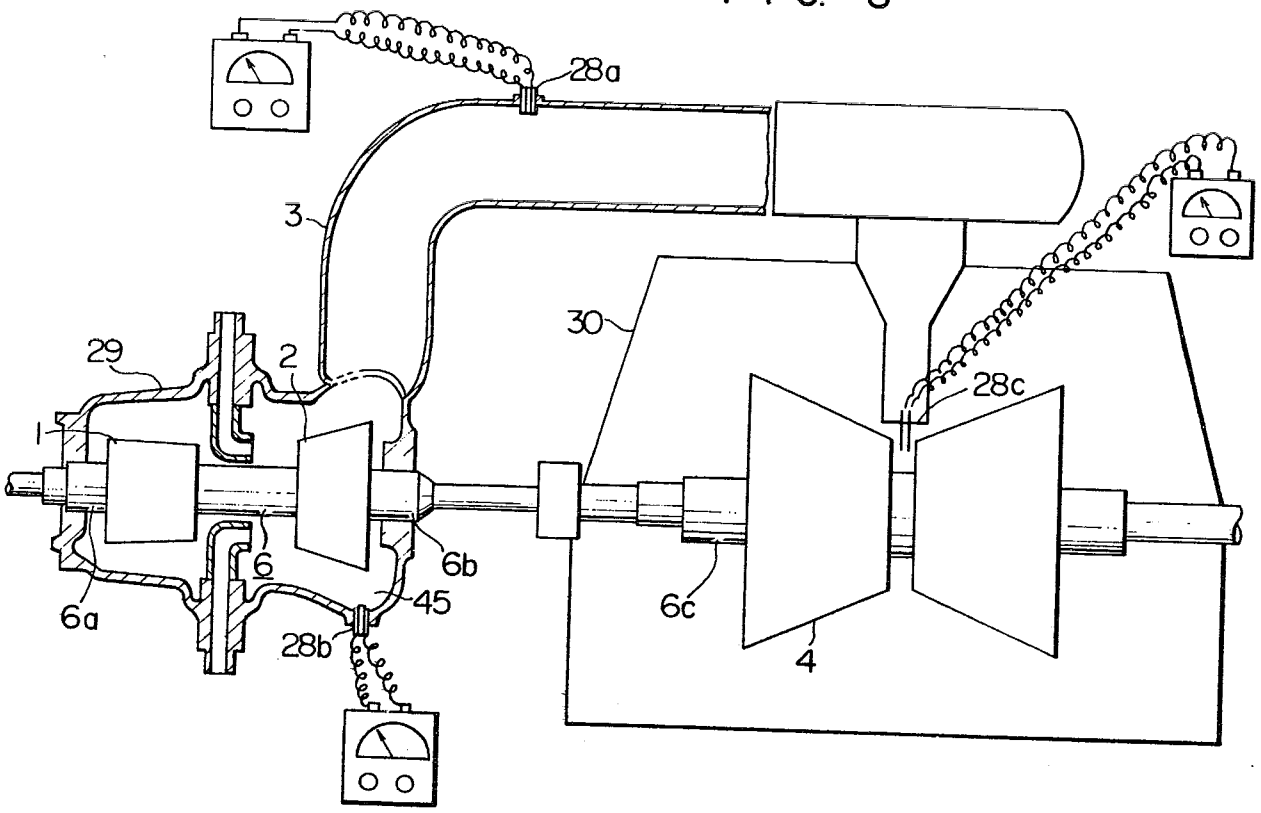
FIG. 8 is a schematic view showing one example of the positions of the temperature sensors used in controlling stress produced in the turbine rotor according to the present invention.

FIG. 8 shows one example of the positions in which temperature determinations are carried out when stress control of the turbine rotor is effected as described hereinabove. With regard to the temperature of the low-temperature portion of the medium-pressure rotor section 6b, the temperature of the inner wall surface of a medium pressure discharge chamber 45 or the temperature of steam therein may be determined by means of a thermocouple 28b, or the temperature of the inner wall surface of crossover conduit 3 or the temperature of steam therein may be determined by means of another thermocouple 28a. With regard to the temperature of the low-temperature rotor section 6c, the temperature of steam at the inlet of the low-pressure turbines may be determined by means of another thermocouple 28c, or the temperature of the inner wall surface of the crossover conduit 3 or the temperature of steam therein may be determined by means of the thermocouple 28a. The temperatures determined by thermocouples 28a to 28c would be substantially equal to one another. Therefore, it is possible to use only one of these thermocouples to determine the temperature and to effect control of stress produced in both of the medium-pressure rotor section 6b and low-pressure rotor section 6c based on the temperature determined by this one thermocoupe. In FIG. 8, 29 designates a casing for the high-pressure and medium-pressure turbines, and 30 designates a casing for the low-pressure turbines.

FIG. 9 shows one embodiment of the stress control system for the turbine rotor according to the present invention. This stress control system is incorporated in a steam turbine having the turbine rotor 6 including the high-pressure rotor section 6a, medium-pressure rotor section 6b and low-pressure rotor section 6c. Like the high-pressure and medium-pressure rotor sections of the steam turbine shown in FIG. 1, the high-pressure rotor section 6a and medium-pressure rotor section 6b are formed integrally into a high-and-medium-pressure rotor section. The steam turbine shown in FIG. 9 is similar to that shown in FIG. 8, and thermocouples 28a to 28c are mounted in the steam turbine shown in FIG. 9, in the same positions as shown in FIG. 8.

In FIG. 9, 32 designates a tachometer for determining the number of revolutions of the turbine rotor. 33A and 33B designate centrifugal stress calculators for medium-pressure rotor section 6b and low-pressure rotor seftion 6c, respectively. Calculators 33A and 33B store therein the data showing the relation between the number of revolutions of the turbine rotor 6 and the centrifugal stresses $\sigma F_1$ and $\sigma F_2$ produced in the bore of the rotor 6, and calculate centrifugal stresses produced in the rotor sections 6b and 6c, respectively, based on the number of revolutions determined by the tachometer 32. 34A designates a temperature calculator for calculating the temperature T1 of a low-temperature portion of the medium-pressure rotor section 6b or a portion of the medium-pressure rotor section 6b facing the outlet of the medium-pressure turbine 2. 34B designates a temperature calculator for calculating the temperature T2 of a portion of the low-pressure rotor section 6c facing the inlet of the low-pressure turbine 4. Calculators 35A and 35B calculate changes $\Delta T1$ and $\Delta T2$, respectively, in the temperatures calculated by the temperature calculators 34A and 34B. The calculators 34A, 34B, 35A and 35B carry out calculation on the basis of the temperatures determined by the thermocouples 28a to 28c.

A temperature limiter 36A for the medium-pressure rotor section 6b is designed to limit the temperature T1 calculated by the calculator 34A or the temperature of the low-temperature portion of the medium-pressure rotor section 6b in such a manner that such temperature is not reduced below the FATT. A temperature limiter 36B for the low-pressure rotor section 6c is designed to limit the temperature T2 calculated by the calculator 34B or the temperature of the portion of the low-pressure rotor section 6c at the steam inlet of the low-pressure turbine 4 in such a manner that such temperature does not cause high-temperature embrittlement. Thermal stresses produced in the medium-pressure rotor section 6b and the low-pressure rotor section 6c are calculated by thermal stress calculators 37A and 37B, respectively. The calculators 37A and 37B are the devices for calculating thermal stresses from the changes $\Delta T1$ and $\Delta T2$ in temperature calculated by the calculators 35A and 35B respectively, with the utilization of, for example, the following equation:

$$\sigma = \frac{E}{1-\nu}\left\{\frac{2}{r_n^2 - r_o^2}\int_{T_o}^{r_n} \alpha_o \quad T \cdot r \cdot dr - \alpha_o T_o\right\}$$

where $\sigma$: stress at rotor bore.
$\nu$: Poisson's ratio.
E: Young's modulus.
$r_n$: radius of outer surface of rotor.
$r_o$: radius of surface of rotor bore.
$\alpha_o$: linear expansion coefficient of rotor material.
T: temperatures of various portions of rotor.
r: radial distance.
$T_o$: surface temperature of rotor bore.

Allowable stresses $\sigma 01$ and $\sigma 02$ corresponding to the brittle fracture toughness at the temperatures T1 and T2, respectively, are calculated by brittle fracture toughness calculators 38A and 38B for the medium-pressure rotor section and low-pressure rotor section, respectively. The calculator 38B calculates the alowable stress $\sigma 02$ for the low-pressure rotor section 6c taking into consideration high-temperature embrittlement of the low-pressure rotor section 6c. The allowable stress $\sigma 01$ is compared with the value of combined stress $\sigma 1$ of the thermal stress $\sigma T1$ and the centrifugal stress $\sigma F1$ at a stress comparator 39A for the medium-pressure rotor section 6b, and the allowable stress $\sigma 02$ is compared with the value of combined stress $\sigma 2$ of the thermal stress $\sigma T2$ and the centrifugal stress $\sigma F2$ at a stress comparator 39B for the low-pressure rotor section 6c. The stress comparators 39A and 39B give instructions to a valve controller 41 to adjust the opening of a valve when the values $\sigma 1$ and $\sigma 2$ of the combined stresses exceed the allowable stresses $\sigma 01$ and $\sigma 02$, respectively. The stress comparators 39A and 39B give instructions to allow operation of the steam turbine to be continued when the values $\sigma 1$ and $\sigma 2$ are below the allowable stresses $\sigma 01$ and $\sigma 02$, respectively, as indicated at 40.

The valve controller 41 is connected to an adjusting valve 42 and a bypass valve 44 for a main stop valve 43 to control the opening of the adjusting valve 42 upon receipt of instructions for limiting load and to control the opening of the bypass valve 44 upon receipt of instructions for limiting the number of revolutions.

From the foregoing, it will be appreciated that in the system for controlling stress shown in FIG. 9, the temperature of the low temperature portion of the medium-pressure rotor section 6*b* is determined by the thermocouple 28*a* mounted in the crossover conduit 3 or the thermocouple 28*b* mounted in the medium-pressure discharge chamber 23, and the temperature T1 of the medium-pressure rotor section 6*b* is calculated by the temperature calculator 34A based on the temperature determined by the thermocouple. The temperature limiter 36A judges whether or not the temperature T1 is below the FATT (Td) (FIG. 6). When the temperature T1 is below the FATT at the time when the number of revolution is being increased during startup, the temperature limiter 36A gives instructions to the valve controller 41 to reduce the opening of the bypass valve 44 to throttle the drive steam from a boiler 31, thereby reducing the turbine speed. In this type of steam turbine system, the adjusting valve 42 is fully open and the main stop valve 43 is fully closed when the number of revolutions is being increased during startup.

The toughness calculator 38A calculates the brittle fracture toughness $\sigma 01$ of the material at the temperature T1, and the calculator 37A calculates the thermal stress $\sigma T1$ produced in the medium-pressure rotor section 6*b* based on the change $\Delta T1$ in temperature of the medium-pressure rotor section 6*b* calculated by the calculator 35A. From the number of revolutions determined by the tachometer 32, the calculator 33A calculates the centrifugal stress $\sigma F1$ produced in the medium-pressure rotor section 6*b*. The value $\sigma 1$ of combined stress of the thermal stress $\sigma T1$ and the centrifugal stress $\sigma F1$ is compared with the brittle fracture toughness $\sigma 01$ at the comparator 39A which gives instructions 40 for continuation of the turbine operation when the value $\sigma 1$ of the combined stress is below the brittle fracture toughness $\sigma 01$. When the value $\sigma 1$ of the combined stress is above the brittle fracture toughness $\sigma 01$, the comparator 39A gives instructions to the valve controller 41 for controlling the valve, so that the opening of the bypass valve 44 is reduced as the number of revolutions of the rotor 6, is increased at startup. At load changes, the opening of the adjusting valve 42 is reduced in accordance with the aforesaid instructions. In this type of steam turbine system, the main stop valve 43 is fully open and the bypass valve 44 is fully closed during steady-state operation after an increase in the number of revolutions of the rotor 6 has been completed. Thus, when the load change causes the value $\sigma 1$ of the combined stress to exceed the brittle fracture toughness $\sigma 01$ at steady-state operation, the adjusting valve 42 is controlled.

The control of stress produced in the low-pressure rotor section 6*c* is effected in the same manner as that effected to the medium-pressure rotor section 6*b* as described hereinabove. However, the temperature limiter 36B for the low-pressure rotor section 6*c* is distinct from the temperature limiter 36A for the medium-pressure rotor section 6*b* in that the former gives instructions to the valve controller 41 to limit the temperature T2 of the low-pressure rotor section 6*c* to a level at which high-temperature embrittlement does not occur. Also, the brittle fracture toughness calculator 38B for the low-pressure rotor section 6*c* is distinct from the corresponding calculator 38A for the medium-pressure rotor section 6*b* in that the former takes high-temperature embrittlement into consideration in calculating the brittle fracture toughness $\sigma 02$.

From the foregoing, it will be apparent that, according to the present invention, the stress produced in the turbine rotor is controlled in such a manner that the brittle fracture toughness of the material of the rotor is not exceeded by the stress. It will be apparent that, by controlling stress according to the present invention, it is possible to increase the safety of the rotor of a steam turbine which is subjected to severe load changes and frequent startup and shutdown.

It will be apparent that stress control according to the present invention can be effected in combination with the aforesaid stress control of the prior art. That is, it would be possible to effect control of life consumption by taking into consideration low-cycle fatigue caused by thermal stress of the base portion A (FIG. 4) of the high-pressure initial stage disk and the base portion B (FIG. 4) of the reheating initial stage disk as well as to effect control of life consumption by taking creep life and thermal stress at the rotor bore into consideration, in addition to the stress control according to the present invention. In order to effect thorough control of stress, the stress control according to the present invention is preferably combined with the stress control of the prior art.

What is claimed is:

1. In a method of controlling stress produced in a rotor of a steam turbine during operation of said turbine, said method comprising the steps of:
   - determining thermal and rotational conditions of said rotor;
   - calculating thermal and centrifugal stresses produced in said rotor from said thermal and rotational conditions, respectively;
   - calculating brittle fracture toughness under said thermal condition of the material of said rotor, and
   - controlling the operation of said turbine to prevent the combined stress of said thermal and centrifugal stresses from exceeding said brittle fracture toughness.

2. A method of controlling stress produced in a rotor of a steam turbine comprising the steps of:
   - calculating the temperature of said rotor from the temperature detected at a predetermined portion of said steam turbine,
   - calculating thermal and centrifugal stresses produced in said rotor from the temperature variation and rotation, respectively, of said rotor,
   - calculating brittle fracture toughness at said calculated temperature of the material of said rotor, and
   - controlling the operation of said turbine to prevent the combined stress of said thermal and centrifugal stresses from exceeding said brittle fracture toughness.

3. A stress controlling method as set forth in claim 2, wherein said rotor includes a high-pressure rotor section, a medium-pressure rotor section and a low-pressure rotor section; wherein temperatures of said medium-pressure and low-pressure rotor sections are calculated in said rotor temperature calculating step, thermal and centrifugal stresses produced in each of said medium-pressure and low-pressure rotor sections are calculated in said stress calculating step, and the brittle fracture toughness of the material of said medium-pressure rotor section and the brittle fracture toughness of the material of said low-pressure rotor section are calculated in said toughness calculating step; and wherein the operation of said turbine is controlled in said turbine operation controlling step to prevent that the combined stress of said thermal and centrifugal stresses in said medium-pressure rotor section exceeds said brittle fracture toughness of said medium-pressure rotor section and that the combined stress of said thermal and centrifugal stresses in said low-pressure rotor section exceeds said brittle fracture toughness of said low-pressure rotor section.

4. A stress controlling method as set forth in claim 3, wherein said brittle fracture toughness of the material of said low-pressure rotor section is calculated taking high-temperature embrittlement of the latter material into consideration.

5. A stress controlling method as set forth in claim 3, further comprising the step of controlling the operation of said turbine to prevent that the temperature of said medium-pressure rotor section lowers below fracture appearance transition temperature of the material of the latter rotor section.

6. A stress controlling method as set forth in claim 3, 4 or 5, further comprising the step of controlling the operation of said turbine to prevent that the temperature of said low-pressure rotor section exceeds the temperature at which the material of said low-pressure rotor section exhibits high-temperature embrittlement.

7. A system for controlling stress produced in a rotor of a steam turbine during operation of said turbine, comprising:

first calculator means for calculating temperature of said rotor from thermal condition of said turbine;

second calculator means for calculating thermal stress produced in said rotor from the temperature variations of said rotor;

third calculator means for calculating centrifugal stress produced in said rotor from rotational condition of said rotor;

fourth calculator means for calculating brittle fracture toughness at said temperature of the material of said rotor;

comparator means for comparing the calculated brittle fracture toughness of said rotor with the combined stress of said thermal and centrifugal stresses; and means for controlling the operation of said steam turbine in response to an output signal of said comparator means.

8. A system for controlling stress as set forth in claim 7, wherein said rotor includes a high-pressure rotor section, a medium-pressure rotor section and a low-pressure rotor section; wherein said first, second, third and fourth calculator means each includes a first calculator for carrying out calculation with regard to said medium-pressure rotor section and a second calculator for carrying out calculation with regard to said low-pressure rotor section; and wherein said comparator means includes a first comparator for comparing the brittle fracture toughness of said medium-pressure rotor section calculated at said first calculator of said fourth calculator means with the combined stress of said thermal and centrifugal stresses produced in said medium-pressure rotor section, and a second comparator for comparing the brittle fracture toughness of said low-pressure rotor section calculated by said second calculator of said fourth calculator means with the combined stress of said thermal and centrifugal stresses produced in said low-pressure rotor section.

9. A system for controlling stress as set fourth in claim 8, further comprising means for controlling the operation of said steam turbine in such a manner that the temperature of said medium-pressure rotor section does not fall below the fracture appearance transition temperature.

10. A system for controlling stress as set forth in claim 8 or 9, further comprising means for controlling the operation of said steam turbine in such a manner that the temperature of said low-pressure rotor section does not rise to a level at which embrittlement due to high temperature of the material of said low-pressure rotor section occurs.

11. A system for controlling stress as set forth in claim 7 or 8, wherein said means for controlling is operable to regulate the quantity of steam supplied to said turbine in a manner acting to prevent the combined stress of said thermal and centrifugal stresses from exceeding said brittle fracture toughness.

* * * * *